US007657355B2

(12) United States Patent
Rau et al.

(10) Patent No.: US 7,657,355 B2
(45) Date of Patent: Feb. 2, 2010

(54) DEVICE FOR ACTUATING A BENDING MAST IN A LARGE MANIPULATOR AND A LARGE MANIPULATOR COMPRISING SAID DEVICE

(75) Inventors: Kurt Rau, Hammersbach (DE); Hartmut Benckert, Filderstadt (DE)

(73) Assignee: Putzmeister Concrete Pumps GmbH, Aichtal (DE)

( * ) Notice: Subject to any disclaimer, the term of this patent is extended or adjusted under 35 U.S.C. 154(b) by 901 days.

(21) Appl. No.: 10/466,671

(22) PCT Filed: Jan. 11, 2002

(86) PCT No.: PCT/EP02/00202

§ 371 (c)(1),
(2), (4) Date: Jul. 21, 2003

(87) PCT Pub. No.: WO02/064912

PCT Pub. Date: Aug. 22, 2002

(65) Prior Publication Data

US 2004/0076503 A1 Apr. 22, 2004

(30) Foreign Application Priority Data

Feb. 14, 2001 (DE) ..... 101 07 107

(51) Int. Cl.
*G06F 19/00* (2006.01)

(52) U.S. Cl. ..... 701/50; 414/699; 60/429; 37/414; 37/348

(58) Field of Classification Search ..... 701/50; 182/2.9; 37/443, 414, 348; 180/306; 187/223; 414/699, 680; 60/421, 429, 430, 468; 172/7; *G06F 19/00*
See application file for complete search history.

(56) References Cited

U.S. PATENT DOCUMENTS 4,791,549 A * 12/1988 Heiser et al. ..... 700/65

(Continued)

FOREIGN PATENT DOCUMENTS

DE 43 06 127 A 9/1994

(Continued)

OTHER PUBLICATIONS

Benckert H, "Computer Controlled Concrete Distribution", Automation and Robotics in Construction International Symposium, Jun. 3-5, 1991, XP000490266, vol. 8, p. 115, paragraph 2.

*Primary Examiner*—Tuan C To
(74) *Attorney, Agent, or Firm*—Patent Central LLC; Stephan A. Pendorf

(57) ABSTRACT

The invention relates to a device for monitoring the safety of a bending pole (22) in a large manipulator, whereby the arms (23-27) of the mast can be pivoted in relation to each other by means of a drive unit (34-38). The relative position of the arms of the mast in relation to the respective adjacent arm of the mast or frame of the mast (21) is measured for adjusting the position thereof. According to the invention, the positing measuring values ($\epsilon_I$) of the arms of the mast are used in order to control the safety of the drive units (34-38) or the actuators thereof (80-84) in relation to a variation of predefined safety values.

18 Claims, 3 Drawing Sheets

U.S. PATENT DOCUMENTS 5,088,020 A * 2/1992 Nishida et al. ..... 700/40
5,107,954 A * 4/1992 Fujimoto ..... 182/2.11
5,268,591 A * 12/1993 Fujimoto ..... 307/9.1
5,472,056 A * 12/1995 Orbach ..... 172/2
5,640,850 A 6/1997 Benckert et al.
5,640,996 A 6/1997 Schlecht et al.
5,823,218 A 10/1998 Schlecht et al.
6,065,565 A * 5/2000 Puszkiewicz et al. ..... 182/2.9
6,138,795 A * 10/2000 Kamiya ..... 187/223
6,158,949 A * 12/2000 Walth et al. ..... 414/722
6,164,415 A * 12/2000 Takeuchi et al. ..... 187/224
6,202,013 B1 3/2001 Anderson et al.
6,234,254 B1 * 5/2001 Dietz et al. ..... 172/3
6,263,595 B1 * 7/2001 Ake ..... 37/348
6,293,099 B1 * 9/2001 Kamiya ..... 60/421
6,312,209 B1 * 11/2001 Duell et al. ..... 414/408
6,349,489 B1 * 2/2002 Sasaki et al. ..... 37/443
6,405,114 B1 * 6/2002 Priestley et al. ..... 701/50
6,434,864 B1 * 8/2002 Epshteyn ..... 37/428
6,443,196 B1 * 9/2002 Kurelek ..... 144/4.1
6,459,976 B1 * 10/2002 Chen et al. ..... 701/50
6,546,325 B1 * 4/2003 Kubota et al. ..... 701/50
6,549,837 B2 * 4/2003 Feucht et al. ..... 701/50
6,582,177 B1 * 6/2003 Westendorf et al. ..... 414/686
6,947,819 B2 * 9/2005 Nelson et al. ..... 701/50

FOREIGN PATENT DOCUMENTS

DE 4412643 3/1995
DE 195 20 166 A 11/1995
EP 0 731 054 A 9/1996
JP 6058209 3/1994
JP 7054813 2/1995
JP 7144884 6/1995
JP 8503755 4/1996
JP 9256419 9/1997
JP 09 328900 12/1997
JP 9328900 12/1997
JP 2000343381 A * 12/2000

* cited by examiner

DEVICE FOR ACTUATING A BENDING MAST IN A LARGE MANIPULATOR AND A LARGE MANIPULATOR COMPRISING SAID DEVICE

CROSS REFERENCE TO RELATED APPLICATION

This application is a national stage of PCT/EP02/00202 filed Jan. 11, 2002 and based upon DE 101 07 107.8 filed Feb. 14, 2001 under the International Convention.

BACKGROUND OF THE INVENTION

1. Field of the Invention

The invention concerns a device for operating an articulated boom, more particularly a concrete placement boom, linked to a boom block, which articulated boom includes at least two boom arms which are respectively limitedly pivotable relative to the boom block or relative to an adjacent boom arm about respective horizontal articulation axes, which articulation axes are parallel to each other, by means of a preferably hydraulic operated drive unit, via a preferably remote control device including a position controller for movement of the boom with the aid of the individual actuating elements associated with the individual drive units, and with sensors associated with the individual boom arms, articulation axes and/or drive axes for the path or angle measurement for position control. The invention further concerns a large manipulator, in particular for concrete pumps, with an articulated boom linked to the boom block and with a device for operating thereof of the type described above.

2. Description of the Related Art

Mobile concrete pumps are conventionally operated by an operator, who is responsible not only for the control of the pump but also for the positioning of the distribution hose which is provided at the tip of the articulated boom. The operator must control multiple rotational degrees of freedom of the articulated boom via the associated drive units with movement of the articulated boom in non-structured three dimensional work space with due consideration of the boundary conditions existing at the construction site. In order to simplify the manipulation or operation in this respect, and operating device has already been proposed (DE-A-430627) in which the redundant articulated axes of the articulated boom are controllable collectively with one single control manipulation of the remote control device in any rotational position of the boom base, independent of the rotation axis thereof. Therein the articulation boom carries out an extension and retraction movement which can be observed by the operator, wherein in addition the elevation or height of the boom tip can be maintained constant. In order to make this possible, the control device includes a remote control device controllable, computer supported coordinate transformer for the drive units, via which the drive units of the articulated boom are actuated in the one main adjustment direction of the remote control device independently of the drive unit for the rotation of the boom base with accomplishment of an extension or retraction movement of the articulated boom while maintaining a predetermined height of the boom tip. In a different main adjustment direction of the remote control device the drive unit or drive unit of the rotation axis of the boom base is operable independent of the drive units of the articulated axis with carrying out a rotation movement of the articulated boom, while in a third main adjustment direction the drive units of the articulated axis are operable independently of the drive units of the rotation axis while carrying out a raising and lowering movement of the boom tip. A basic precondition for such an operation of the articulated boom is a position controller which includes among other things a sensor or sensor logic for the path or angle measurement associated with the individual boom arms, articulation axes and/or drive units. Since faults in technical systems of this type, which include not only mechanical but also electronic and hydraulic components, cannot be completely avoided, there is a need for a safety monitoring system which warns the user and when necessary takes action for safety purposes. Therein it is necessary, to recognize and evaluate the occurring problems by sensing with the objective to overcome the faults at least temporarily and to prevent undesired faulty operations and damage. A turning off of the boom and pump functions has until now been possible using an emergency turnoff switch, which is operated by the user.

SUMMARY OF THE INVENTION

Beginning therewith, it is the task of the present invention to improve the large manipulator of the above-described type in such a manner that safety monitoring becomes possible independent of the operator.

For solving this task, there is proposed the combination of characteristics as set forth in Patent Claims 1, 11 and 21. Advantageous embodiments and further developments of the invention can be seen in the dependent claims.

The inventive solution is based upon the realization, that the sensors for the path or angle determination, which are already present for position control, can, by taking into consideration additional criteria which occur in the case of specific failures, make possible an automatic safety monitoring. In order to accomplish this, it is proposed in accordance with the invention that the operating device includes a safety program, taking into consideration sensors for controlling the actuating elements, according to the value of predetermined safety criteria. A particularly important part of the operating device is comprised therein, that the safety program includes at least one evaluation component for output of an acoustic or optical warning signal, which alerts the operator to the occurrence of faults.

According to a preferred embodiment of the invention, wherein each drive unit includes a double acting or reciprocating hydraulic cylinder, the hydraulic cylinders are acted upon with hydraulic fluid via respectively one proportional changeover valve forming the associated actuating element, and the proportional changeover valves are supplied with hydraulic fluid via a common supply line, it is proposed in accordance with the invention that the supply line is provided with a supply valve which is controllable via the safety program. Depending upon the condition of the supply valve upon occurrence of the fault, it can be switched open or closed on the basis of the evaluation of the fundamental safety criteria. The supply valve can in addition be assigned a supplemental function. For example it can be designed within the system as a simplex or half duplex operation valve for selective supplying of the boom arm valves and the support arm valves.

Preferably the safety program can include various evaluation components, which individually or in combination address

- the condition of the switching of the supply valve,
- the presence or absence of control input via the remote control,
- control deviations with reference to the path or angle, which are greater than predetermined threshold values,
- the speed of path or angle control deviations which are greater than the predetermined threshold valves, and angular velocities which are greater than predetermined threshold valves.

Further, pressure sensors can be provided on the piston side and rod side ends of the drive unit which is in the form of a hydraulic cylinder, wherein the safety program or protocol includes an evaluation component responsive to the output data of the pressure sensors.

An aspect of the invention is a large manipulator with the above-described characteristics of a boom operating device with safety features.

The inventive features can also be defined in process terms, in that for the safety monitoring of an articulated boom in a large manipulator, in which the boom arms of the articulated boom are pivotable relative to each other by means of a drive unit and the relative position of the boom arms relative to the boom block or to an adjacent boom arm are continuously monitored for position control, it is the position measuring values of the boom arms that are used for safety control of the actuating elements in accordance with a deviation from predetermined safety threshold values. In particular, a warning signal can be triggered upon exceeding the safety threshold values. If the drive units for the boom arms are driven hydraulically using hydraulic fluid, it has been found to be particularly advantageous, that upon a deviation from the predetermined safety threshold values the supply of hydraulic fluid is switched off or, depending upon circumstances, switched to the drive units. In particular in the case of stationary operation with switched off hydraulic fluid supply, the hydraulic fluid supply and therewith also the position control is switched on when the angle velocity is not zero and a predetermined deviation threshold is not exceeded. The term "stationary operation" is herein intended to mean pump operation without movement of the articulated boom. The low angular velocity indicates, as the evaluation criteria, a small leak in the hydraulic system or an actuating element or drive unit with a small defect, wherein in an emergency operation still a controlled return guidance of the articulated boom in a safe transport position with assistance of the position controller is possible. If however the predetermined angular velocity threshold is exceeded, then the hydraulic oil supply and therewith also the position control remains switched off. The operator must then secure the articulated mast on-site or take measures for transporting.

A similar situation occurs when in the movement operation the speed or velocity of the control deviation exceeds a predetermined threshold. In this situation, in the case of turned-on hydraulic fluids supply, the hydraulic fluid supply and therewith also the position control are switched off.

BRIEF DESCRIPTION OF THE DRAWINGS

In the following the invention will be described in greater detail on the basis of a illustrative embodiment shown in schematic manner in the figure. There is shown FIG. 1 a side view of a mobile concrete pump with collapsed articulated boom.

DETAILED DESCRIPTION OF THE INVENTION

Figure 1:
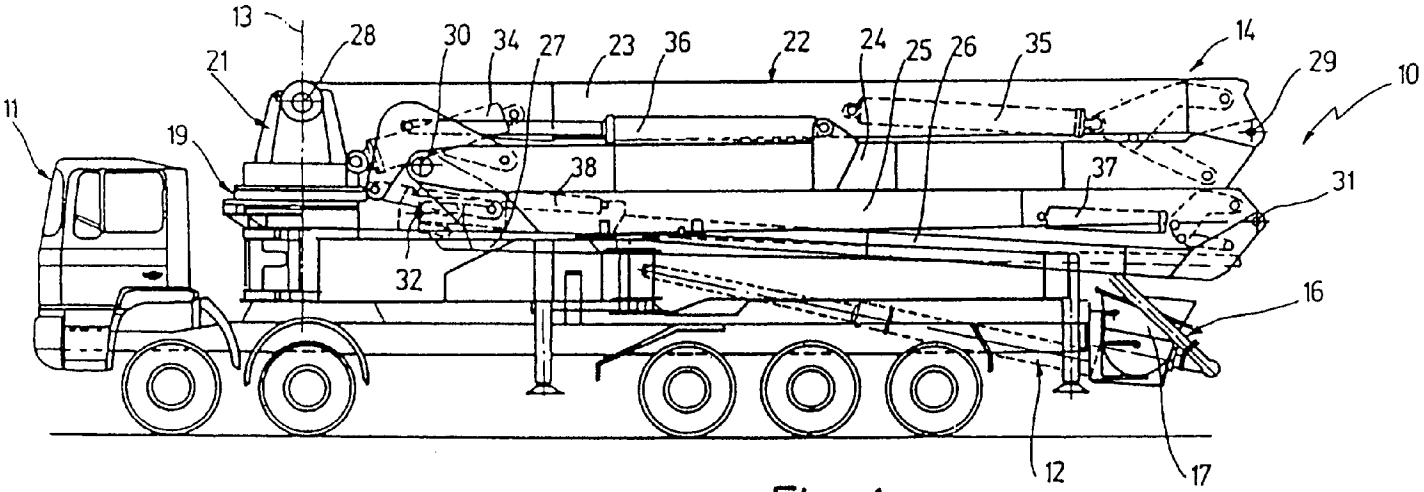

The mobile concrete pump 10 includes a transport vehicle 11, a thick matter pump 12 in the form of for example a two cylinder piston pump as well as a concrete placement boom 14 rotatable about a vehicle-fixed vertical axis 13 as carrier for a concrete distribution line 16. Via the concrete distribution line 16 fluid concrete, which is introduced continuously into a supply container 17 during concretizing, is conveyed to a concretizing location 18 located distant from the location of the vehicle 11.

Figure 2:
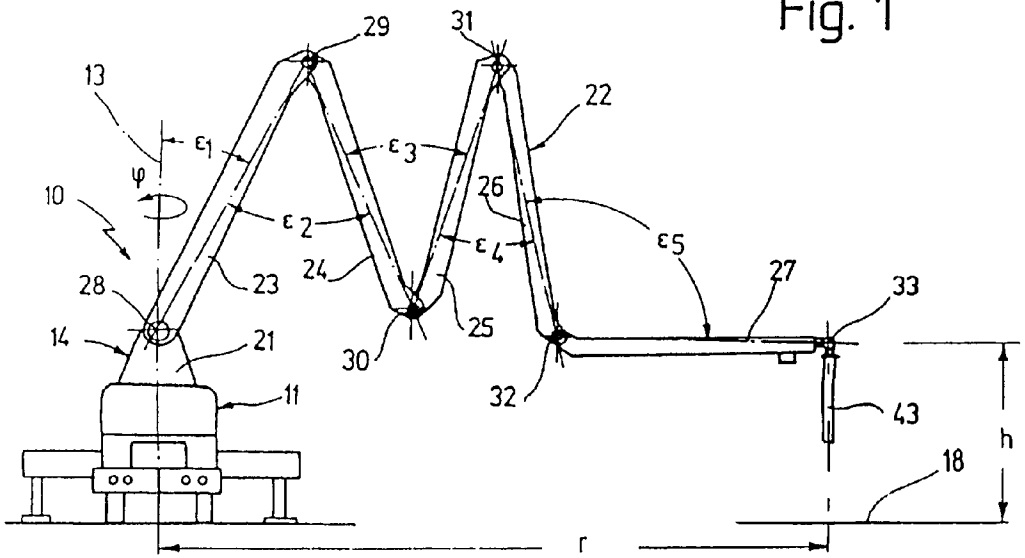
FIG. 2 a mobile concrete pump according to FIG. 1 with articulated boom in working position.

The placement boom 14 is comprised of a boom block 21 rotatable about the vertical axis 13 via a hydraulic rotation drive 19 and an articulated boom 22 which is continuously adjustable to various reaches r and height differentials h between the vehicle 11 and the concretization location 18. The articulated boom 22 is comprised in the illustrated embodiment of five articulated boom arms 22 through 27 connected to each other, which are pivotable about axes 28 to 32 running parallel to each other and at right angles to the vertical axis 13 of the placement boom 21. The articulation angle $\epsilon_1$ through $\epsilon_5$ (FIG. 2) of the articulated linkages formed by the articulated axes 28 to 32 and their orientation or arrangement relative to each other is so determined relative to each other that the placement boom 14, as can be seen from FIG. 1, following multiple folding, is collapsible to a space-saving transport configuration upon the vehicle 11. By an activation of drive units 34 to 38, which are individually associated with the articulation axes 28 to 32, the articulated boom 22 can be unfolded to various distances r and/or height differentials h between the concretizing location 18 and the vehicle location (FIG. 2).

The remote control device 50 includes in the illustrated embodiment a remote control element 60 in the form of a control lever, which can be moved in three main directions back and forth with output of control signals 64. The control signals are transmitted along a radio wave transmission path 68 to a radio receiver 70 integrated in the vehicle, the output of which receiver is connected to a micro-controller 74 via a bus system 72 in the form of, for example, a CAN-bus. The micro-controller 74 includes a software module 76, 77 which interprets the control signals 64 received from the remote control device 50, transforms and translates these via a position controller 92 and a subsequent arranged signal provider 94 into operating signals for the drive units 34 through 36. The operation or actuation of the drive units 34 through 36 occurs via the actuator elements 80 through 84 which are in the form of proportional changeover valves, which are connected with their outlet lines 86, 87 to the piston side and rod side of the drive units 34 through 38 which are in the form of double acting hydraulic cylinders. The drive unit 19 for the boom block 21 is in the form of a hydraulic rotation drive, which is controlled via the actuating element 85.

Subsequent to the interpretation routine 76 is a software module in the form of a coordinate transformer 77, of which it is the main task to transform the incoming control signal interpreted as cylinder coordinates $\phi$,r,h into predetermined clock pulses into angle signals $\phi,\epsilon_I$ for the rotation and tilt or inclination axis 13, 28 through 32, wherein the drive units of the redundant articulated axis 28 to 32 of the articulated mast 22 are respectively operable or drivable according to the value of a predetermined path-tilt-characteristic. Each articulation axis 28 to 32 is so controlled using software within the coordinate transformer 77 that the articulated linkages move harmonically relative to each other as a function of path and time. The control of the redundant degrees of freedom of the articulated linkages occurs thus according to a preprogrammed strategy, with which the self collision with adjacent boom arms 23 through 27 can be precluded during the course of movement. For increasing precision it is, besides this, possible to make use of correction data stored in the memory for compensation of a load-dependent deformation. The angular changes achieved in this manner in the coordinate transformer 77 are compared in the position controller 92 with the intended values provided by the angle provider or controller 96 and converted via the signal provider 94 into actuation signals $U_\epsilon$ for the drive units 19, 34 through 38.

Besides control via the coordinate provider 64, which interprets the incoming data as cylinder coordinates and appropriately translates them (see DE-A-4306127), the individual drive units 19, 34 through 36 can also be controlled directly via the control element 60 and the associated actuation elements 66 through 76.

Figure 3:
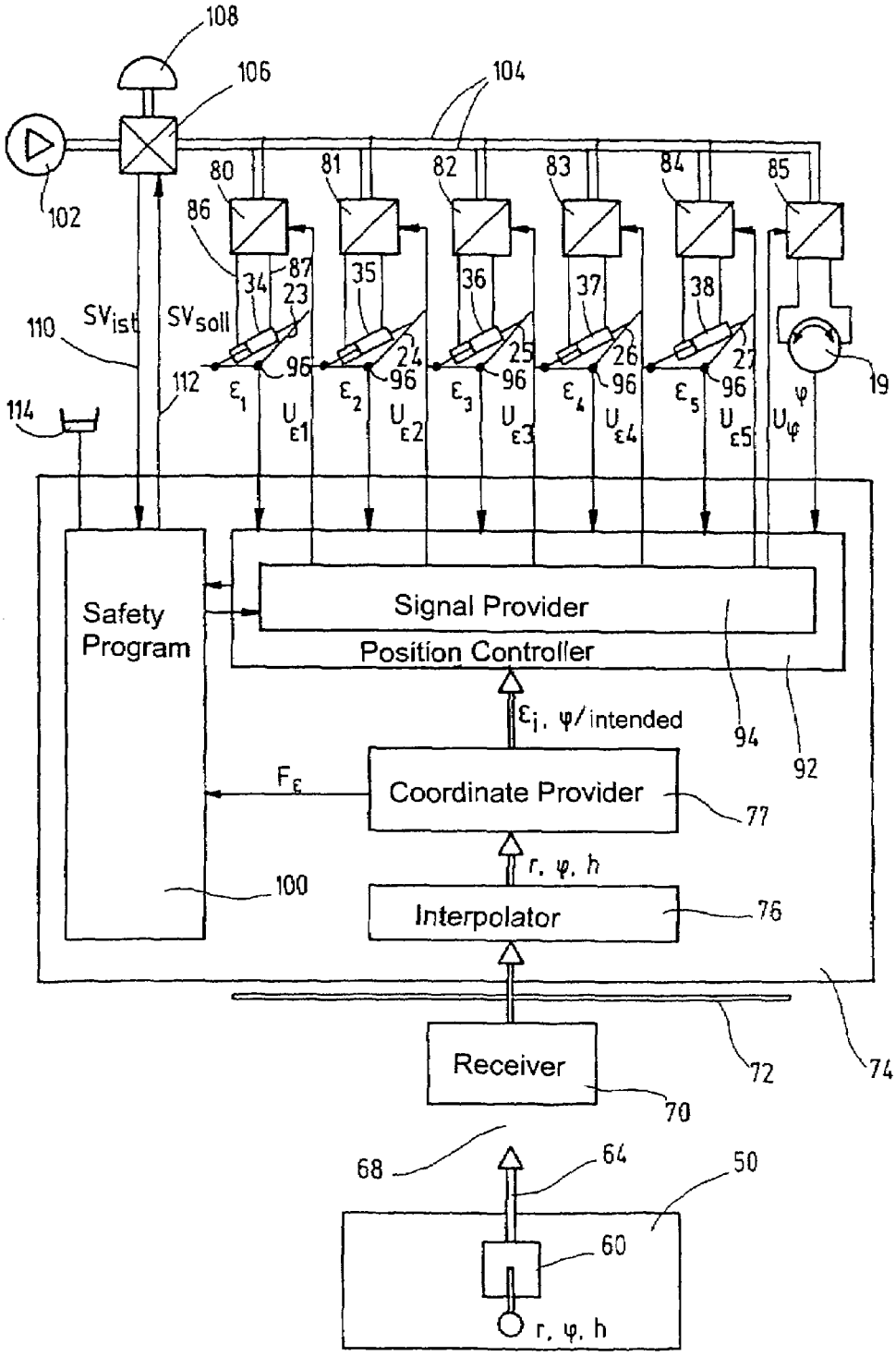
FIG. 3 a flow diagram of a device for operating the articulated mast with safety monitoring.

A feature of the device shown in FIG. 3 is comprised therein, that the micro-controller 74 of the control device includes an evaluation and safety program 100 responsive to the output data of the sensor 96 for controlling the actuating elements 80 through 84 in the form of proportional changeover valves depending upon the magnitude of the predetermined safety criteria. The actuating elements are acted upon with hydraulic pressure via pump 102 and a supply line 104. An on/off supply valve 106 is located in the supply line 104, which can be in the form of, for example, a simplex or half duplex operation valve, via which selectively also the chassis support leg hydraulics of the mobile concrete pump 10 is supplied. In the area of the supply valve 106 there is located an emergency shutoff switch 108, via which the operator can in an emergency interrupt the supply of hydraulic fluid along supply line 104. As described in greater detail below on the basis of FIG. 4, the evaluation and safety program 100 also acts via signal lines 110, 112 on the supply valve 106. Besides this, in the case of a fault, the safety program can initiate an acoustic or optical signal device 114. In the safety program 100 the measurement data of the angle provider 96 are evaluated, just as in the position controller 92, on the basis of defined safety criteria and translated into control signals for the supply valve 106, the warning signal emitter 114 and the signal provider 94 for controlling the actuating elements 80 through 84.

The safety monitoring in the evaluation and safety program 100 occurs with reference to the axes. By way of example and on the basis of the flow diagram shown in FIG. 4 the monitoring logic of an articulation axis is explained.

Figure 4:
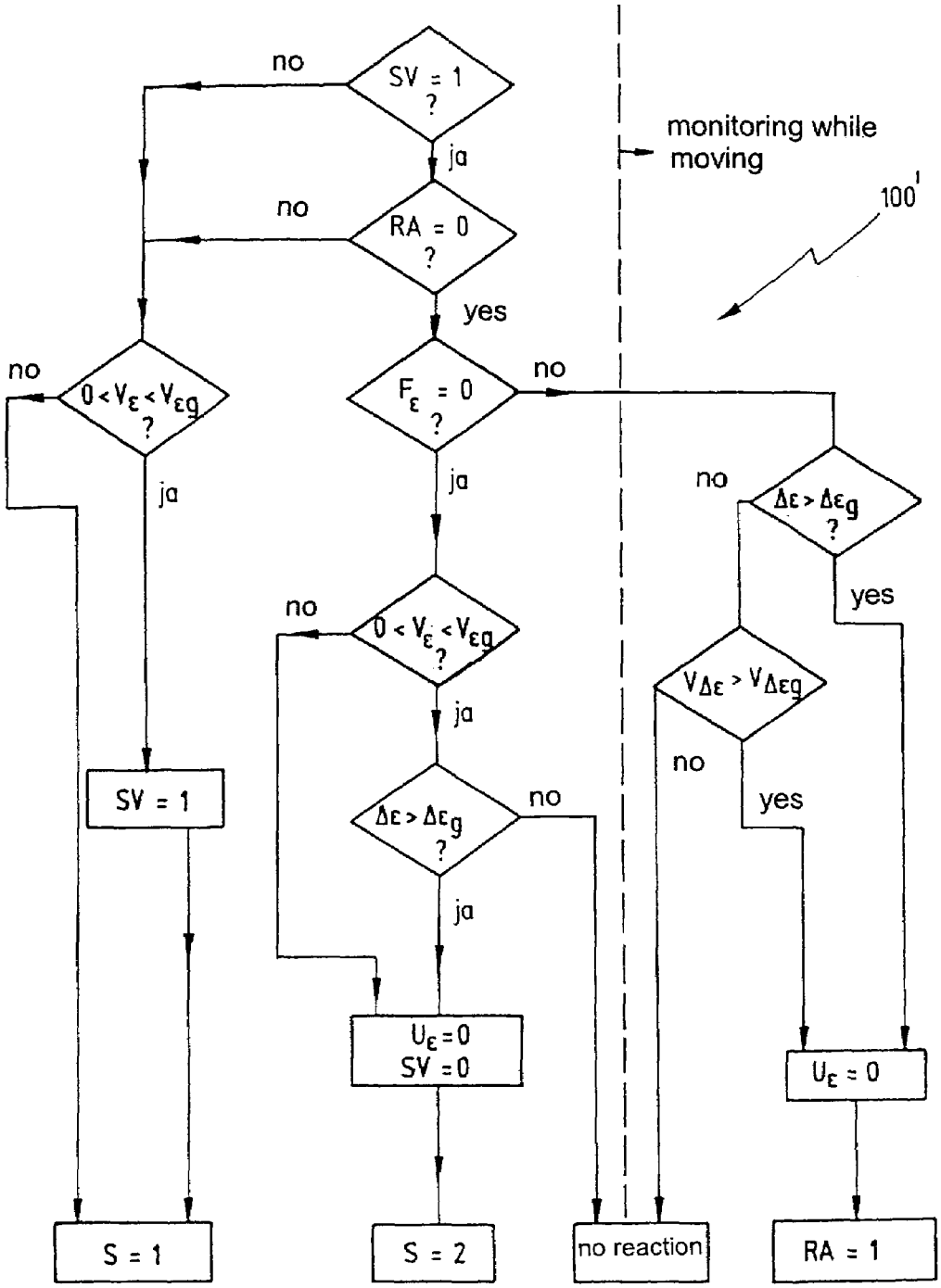
FIG. 4 a flow diagram of an axis-based safety protocol.

The safety routine 100' according to FIG. 4 includes evaluation components (safety criteria) for the following values:

Input Values (Comparison Values)

$\varepsilon(t)$ = measured angle $\varepsilon$ of the selected articulation axis at time $t$ $\varepsilon_{soll}(t)$ = intended value of the concerned angle $\Delta\varepsilon(t) = \varepsilon_{intended}(t) - \varepsilon(t)$ = control deviation at time $t$ $\Delta\varepsilon_g$ = adjustable threshold value therefore $V_\varepsilon = (\varepsilon(t) - \varepsilon(t - \Delta t)/\Delta t$ = angular velocity at time $t$ $V_{\varepsilon_g}$ = adjustable threshold value therefore (for example $0.3°/s$)

$V_{\Delta\varepsilon} = (\Delta\varepsilon(t) - \Delta\varepsilon(t - \Delta t)/\Delta t$ = change velocity of the control deviation at time $t$ $V_{\Delta\varepsilon_g}$ = adjustable threshold value therefore $F_\varepsilon$ = travel allowance for angle $\varepsilon$ = 0: angle $\varepsilon$ maintaining -continued $\neq 0$: angle $\varepsilon$ changing (moving)

$SV$ = control supply valve (intended condition)

= 1: hydraulic fluid sent to control elements (releasing boom)

at the same time: axis is controlled or blocked

= 0: hydraulic fluid blocked to control elements at the same time: axis is not controlled or blocked Outvalues (Set Values)

$SV$ = driving the supply valve (intended condition)

$U_\varepsilon$ = control value for the actuating element for axis $\varepsilon$ $S$ = warning signal at the signal provider (for example horn, light)

= 1: leakage warning

= 2: defect warning sensor/actuator $RA$ = control internal error or failure cell (control deviation limit for $\Delta\varepsilon_g$ or as the case may be $V_{\Delta\varepsilon_g}$ is exceeded).

The axis-specific safety program 100' is carried out in real time in predetermined time intervals. In the main branch there is sequentially checked the operating condition of the supply valve SV, the condition of the failure cell RA and the drive or extension input $F_\epsilon$. If in the main branch no impermissible deviations of the angular velocity $V_\epsilon$ and the control deviation $\Delta\epsilon$ from the respective threshold value is determined, then the system is controllable, so that no error announcement is made (no reaction). If in contrast a threshold value is exceeded in the values $V_\epsilon$ or as the case may be $\Delta\epsilon$, then this is assumed to have the meaning of a significant defect, which can lead to a switching off of the axis movement ($U_\epsilon$=0) and to a blockage of the supply valve (SV=0). At the same time there is produced a defect warning sensor/actuator (S=2) via the signal device 114. This setting or position has the same effect as an emergency cutoff, which gives the operator opportunity to find the source of the problem and to remedy the same or to bring the articulated boom into the transport position according to FIG. 1 using manual operation.

The left branch of the safety program 100' is run primarily in the stationary condition, when for example concrete is being extruded without movement of the articulated mast. In this case the supply valve 106 is closed (SV=0) and the position controller 92 is switched off. Nevertheless the angular velocity $V_\epsilon$ of the concerned axis is being continuously monitored by comparison with the associated threshold value $V_{\epsilon_g}$. If a small change occurs, then the supply valve 106 is engaged (SV=1) and therewith the position control 92 is engaged. In the case of a large leakage ("no"-branch) the supply valve 106 and the position control 92 remain switched off. In both cases a leakage warning (S=1) is produced, which in the first case makes possible an emergency operation for controlled return of the articulated boom into a safe transport position with aid of the position controller. In the latter case the boom hydraulic is without pressure, so that only a recovery, however no operation of the articulated boom, is possible.

The right branch in the flow diagram of the safety program 100' shows the evaluation of safety criteria during the moving operation ($F_\epsilon \neq 0$). The control value to the actuating element is in this case first $U_\epsilon \neq 0$. It is sequentially checked whether the control deviation $\Delta\epsilon$ and the change velocity of the control deviation $V_{\Delta\epsilon}$ exceeds the respective threshold value. If this is not the case, then error-free normal operation must be occurring (no reaction). If at least one of the thresholds is exceeded, then the control value $U_\epsilon$ for the concerned actuating element is set to zero and the control internal error cell RA=1.

Appropriate safety routines are carried out in real time operation for all axes of the system.

In summary the following can be concluded: The invention concerns a device for monitoring the safety of an articulated boom 22 of a large manipulator, in which the mast arms 23 through 27 of the articulated boom 22 are pivotable relative to each other respectively via a drive unit 34 through 38, wherein the relative position of the boom arms relative to the respective adjacent boom arm or mast block 21 is measured for position control. In accordance with the invention the position measured values $\epsilon_I$ of the boom arms are used for safety control of the drive unit 34 through 38 or as the case may be their actuation elements 80 through 84 depending upon the value of their deviation from the preset safety threshold values.

The invention claimed is:

1. A device for operating an articulated boom (22) of a concrete placement boom (14) linked to a boom block (21), of which the articulated boom includes at least two boom arms (23 through 27), which are respectively limitedly pivotable relative to the boom block (21) or an adjacent boom arm about respective parallel horizontal articulation axes (28 through 32) via hydraulic drive units (34 through 38), the device comprising:

a remote control element (50) for transmission of control signals and a receiver (70) and micro-controller (74) for receiving said control signals for boom movement with help of actuator elements (80 through 84) associated with the individual drive units (34 through 38), the micro-controller including a position controller (92), and sensors (96) associated with the individual boom arms, articulation axes and/or drive units for measurement of path or angle for the position controller (92), wherein the drive units (34-38) are supplied with hydraulic fluid via a common supply line (104), wherein a supply valve (106) is located in the common supply line (104), and wherein the micro-controller (74) includes a computer readable memory on which a safety program (100, 100') is recorded, said safety program being responsive to output data of the sensors (96) for controlling the supply valve (106) depending upon a value of a predetermined safety criteria, wherein the safety program (100') includes an evaluation component, which is responsive to the switch-on condition (SV) of the supply valve (106).

2. The device according to claim 1, wherein the safety program (100') includes at least one evaluation component for triggering an acoustic or optical warning signal through an acoustic or optical signal device (114).

3. The device according to claim 1, wherein each drive unit (34 through 38) includes a double acting hydraulic cylinder, wherein the hydraulic cylinder is acted upon with hydraulic fluid via respectively one of the associated actuating elements (80-64) in the form of a proportional changeover valve, and wherein the proportional changeover valves are supplied with hydraulic fluid via the common supply line (104).

4. The device according to claim 3, wherein the supply valve (106) is a simplex valve for selective supplying of the proportional change valves associated with the mast arms and for supplying the support strut valves.

5. The device according to claim 1, wherein the safety program (100') includes an evaluation component, which is responsive to the presence or absence of movement instructions ($F_\epsilon$) from the remote control (60).

6. The device according to claim 1, wherein the safety program (100') includes an evaluation component, which is responsive to path or angle oriented control deviations ($\Delta\epsilon$) which are greater than the predetermined threshold value ($\Delta\epsilon_g$).

7. The device according to claim 1, wherein the safety program (100') includes an evaluation component, which is responsive to the velocity of the path or angle referenced control deviation ($V_{\Delta\epsilon}$), which is greater than the predetermined threshold value ($\Delta_{\Delta\epsilon g}$).

8. The device according to claim 1, wherein the safety program (100') includes an evaluation component, which is responsive to an angular velocity ($V_\epsilon$), which is greater than the predetermined threshold value ($V_{\epsilon g}$).

9. The device according to claim 1, wherein pressure sensors are provided on the piston side and rod side ends of the drive unit (34 through 38), which is in the form of a hydraulic cylinder, and wherein the safety program includes an evaluation component responsive to the output data of the pressure sensors.

10. A device for operating an articulated boom (22) of a concrete placement boom (14) linked to a boom block (21), of which the articulated boom includes at least two boom arms (23 through 27), which are respectively limitedly pivotable relative to the boom block (21) or an adjacent boom arm about respective parallel horizontal articulation axes (28 through 32) via hydraulic drive units (34 through 38), the device comprising:

a control device for input of control signals and a micro-controller (74) receiving said control signals for boom movement with help of actuator elements (80 through 84) associated with the individual drive units (34 through 38), the micro-controller including a position controller (92), and sensors (96) associated with the individual boom arms, articulation axes and/or drive units for measurement of path or angle for the position controller (92), wherein the drive units (34-38) are supplied with hydraulic fluid via a common supply line (104), wherein a supply valve (106) is located in the common supply line (104), and wherein the micro-controller (74) includes a computer readable memory on which a safety program (100, 100') is recorded, said safety program being responsive to output data of the sensors (96) for controlling the supply valve (106) depending upon a value of a predetermined safety criteria, wherein the safety program (100') includes an evaluation component, which is responsive to the switch-on condition (SV) of the supply valve (106).

11. The device according to claim 10, wherein the safety program (100') includes at least one evaluation component for triggering an acoustic or optical warning signal through an acoustic or optical signal device (114).

12. The device according to claim 10, wherein each drive unit (34 through 38) includes a double acting hydraulic cylinder, wherein the hydraulic cylinder is acted upon with hydraulic fluid via respectively one of the associated actuating elements (80-84) in the form of a proportional changeover valve, and wherein the proportional changeover valves are supplied with hydraulic fluid via the common supply line (104).

13. The device according to claim 12, wherein the supply valve (106) is a simplex valve for selective supplying of the proportional change valves associated with the mast arms and for supplying the support strut valves.

14. The device according to claim 10, wherein the safety program (100') includes an evaluation component, which is responsive to the presence or absence of movement instructions ($F_\epsilon$) from the control device.

15. The device according to claim 10, wherein the safety program (100') includes an evaluation component, which is responsive to path or angle oriented control deviations ($\Delta\epsilon$) which are greater than the predetermined threshold value ($\Delta\epsilon_g$).

16. The device according to claim 10, wherein the safety program (100') includes an evaluation component, which is responsive to the velocity of the path or angle referenced control deviation ($V_{\Delta\epsilon}$), which is greater than the predetermined threshold value ($V_{\Delta\epsilon g}$).

17. The device according to claim 10, wherein the safety program (100') includes an evaluation component, which is responsive to an angular velocity ($V_\epsilon$), which is greater than the predetermined threshold value ($V_{\epsilon g}$).

18. The device according to claim 10, wherein pressure sensors are provided on the piston side and rod side ends of the drive unit (34 through 38), which is in the form of a hydraulic cylinder, and wherein the safety program includes an evaluation component responsive to the output data of the pressure sensors.

* * * * *